US005902141A

United States Patent [19]

Iwahori

[11] Patent Number: 5,902,141

[45] Date of Patent: May 11, 1999

[54] LOW INSERTION PRESSURE CONNECTOR

[75] Inventor: Yoshihiro Iwahori, Shizuoka, Japan

[73] Assignee: Yazaki Corporation, Tokyo, Japan

[21] Appl. No.: 08/818,007

[22] Filed: Mar. 14, 1997

[30] Foreign Application Priority Data

Mar. 29, 1996 [JP] Japan ..... 8-076763

[51] Int. Cl.[6] ..... H01R 13/62

[52] U.S. Cl. ..... 439/157

[58] Field of Search ..... 439/152–160, 439/372

[56] References Cited

U.S. PATENT DOCUMENTS

| | | | |
|---|---|---|---|
| 5,326,274 | 7/1994 | Pfaff et al. | 439/157 |
| 5,618,194 | 4/1997 | Maue et al. | 439/157 |
| 5,672,067 | 9/1997 | Ryll et al. | 439/157 |

FOREIGN PATENT DOCUMENTS 61-203581 9/1986 Japan .

*Primary Examiner*—Steven L. Stephan
*Assistant Examiner*—Brian J. Biggi
*Attorney, Agent, or Firm*—Sughrue, Mion, Zinn, Macpeak & Seas, PLLC

[57] ABSTRACT

A low insertion pressure connector including a female connector housing, a male connector housing, a slider provided so as to be slidable in the female connector housing, a temporary lock mechanism for locking the slider in a temporary lock position, cam grooves for moving the slider from the temporary lock position to a normal lock position to thereby move the male connector housing from an initial fitting position to a normal fitting position, in which a lock claw acting as the temporary lock mechanism and a releasing protrusion are provided on a flexible arm so that the male connector housing is moved into the initial fitting position, an engagement convex portion to be fitted into the cam groove pushes down the releasing protrusion project into the cam groove to bend the flexible arm to thereby release the temporary lock.

5 Claims, 5 Drawing Sheets

LOW INSERTION PRESSURE CONNECTOR

BACKGROUND OF THE INVENTION

1. Field of the Invention

This invention relates to a slider type low insertion pressure connector.

2. Background

A connector disclosed in Unexamined Japanese Patent Publication No. Sho. 61-203581 is known as such a connector as mentioned above. FIG. 5 shows an example of the connector.

This connector includes a female connector housing 1, a male connector housing 2 fitted into a fitting hole 4 of the female connector housing 1, and a slider 3 which is inserted into insertion holes 5 of the female connector housing 1 so as to be slidable in a direction perpendicular to a connector fitting direction F.

The slider 3 is U-shaped and has upper and lower slide plates 13 and 14 slidable along upper and lower outer wall surfaces 2*a* of the male connector housing 2, and an operation portion 12 for connecting the upper and lower slide plates 13 and 14 in one side. Flexible arms 7 are provided in the female connector housing 1. The flexible arms 7 have temporary lock claws 8 and normal lock claws 9. The slider 3 has temporary lock portions 16 which engage with the temporary lock claws 8 in the female connector housing 1 side when the slider 3 is in a temporary lock position in which the slider 3 is inserted shallowly, and normal lock portions 17 which engage with the normal lock claws 9 in the female connector housing 1 side when the slider 3 is in a normal lock position in which the slider 3 is inserted deeply.

Further, engagement convex portions 10, 10 are provided on the upper and lower outer wall surfaces 2*a* of the male connector housing 2 whereas cam grooves 15, 15 are formed in the inner surfaces of the upper and lower slide plates 13 and 14 of the slider 3 so as to engage with the engagement convex portions 10, 10. The cam grooves 15, 15 which cooperate with the engagement convex portions 10, 10 to form a cam mechanism, have inlets 15*a* parallel with the connector fitting direction F, and inclination portions 15*b* provided in the rear side so as to be inclined with respect to the connector fitting direction F.

In use of this connector, the upper and lower slide plates 13 and 14 of the slider 3 are first inserted into the female connector housing 1 through insertion holes 5 of the female connector housing 1 as shown in FIG. 6*a* so that the slider 3 reaches a temporary lock position as shown in FIG. 6*b*. As a result, the temporary lock claws 8 engage with the temporary lock portions 16, so that the position of the slider 3 is retained. In this state, the male connector housing 2 is fitted so as to reach an initial lock position. As a result, the engagement convex portions 10 of the male connector housing 2 enter to the start points of the inclination portions 15*b* from the inlets 15*a* of the cam grooves 15 in the slider 3.

When the slider 3 in this state is inserted deeply so as to reach the normal lock position as shown in FIG. 6*c*, the engagement convex portions 10 are guided to the depth by the action of the inclination portions 15*b* of the cam grooves 15 so that the male connector housing 2 reaches the normal fitting position in the inside of the female connector housing 1 and the two connector housings 1 and 2 are fitted to each other. Further, the normal lock claws 9 engage with the normal lock portions 17 so that the slider 3 is normally locked and the two connector housings 1 and 2 are locked in the normal fitting state.

Incidentally, in the aforementioned conventional connector, predetermined lock strengths are given to the lock claws 8 and the flexible arms 7 respectively in order to retain the temporary lock state of the slider 3. There may still occur, however, such a situation that the slider 3 is moved from the temporary lock position to the normal lock position due to a shock, or the like, at the time of carrying the connector so that the slider 3 must be returned to the temporary lock position at the time of connector fitting operation. That is, workability is poor. If the strength for the temporary lock is selected to be larger in order to prevent the workability from becoming poor, a wasteful force is required for operating the slider 3 to the normal lock position to thereby bring about a problem that the original function of the low insertion pressure connector is spoiled.

SUMMARY OF THE INVENTION

Taking such circumstances into consideration, an object of the present invention is to provide a low insertion pressure connector in which connector fitting can be performed by a slight slider operating force, and a slider temporarily locked before connector fitting can be retained securely so as not to be easily moved to a normal lock position.

In order to achieve the above object, according to an aspect of the present invention, provided is a low insertion pressure connector which includes: first and second connector housings fitted to each other; a slider provided so as to be slidable on the first connector housing in a direction perpendicular to the direction of fitting of the first and second connector housings; a temporary lock mechanism for locking the slider in a temporary lock position; and a cam mechanism provided between the slider and the second connector housing for making the slider slide from the temporary lock position to a normal lock position to thereby move the second connector housing from an initial fitting position to a normal fitting position, in which the low insertion pressure connector further includes a temporary lock releasing member for releasing the temporary lock state of the slider by the temporary lock mechanism when the second connector housing is fitted in the initial fitting position.

According to the first aspect of the present invention, since the temporary lock state of the slider is released before the slider is moved from the temporary lock position to the normal lock position, no force is required for releasing the temporary lock state of the slider when the slider is moved for the purpose of connector fitting. Accordingly, it is possible to improve the original function of the low insertion pressure connector which is such that connector fitting can be performed by a slight force. Furthermore, since the temporary lock state of the slider is not released by the operation (for example, intensively pushing) of the slider at the time of connector fitting, there is no problem even in the case where the strength of the temporary lock mechanism is selected in advance so that the force required for the temporary lock becomes large. That is, such a situation that the slider is moved from the temporary lock position to the normal lock position by mistake due to a shock, or the like, at the time of carrying the connector can be prevented. Accordingly, improvement of workability is attained.

According to a second aspect of the present invention, in the low insertion pressure connector of the first aspect of the present invention, flexible arms having lock claws for temporarily locking the slider, and release protrusions for releasing the temporary lock state of the slider are provided in the first connector housing, and engagement convex portions for making interference with the release protrusions to bend the flexible arms to thereby release the temporary lock state of the slider when the second connector housing is fitted in the initial fitting position are provided in the second connector housing, the temporary lock mechanism has the lock claws, and the temporary lock releasing member has the release protrusions and the engagement convex portions.

According to the second aspect of the present invention, when the second connector housing is fitted in the initial fitting position in a state in which the slider is temporarily locked, the engagement convex portions provided in the second connector housing interfere with the release protrusions to bend the flexible arms to thereby release the temporary lock state. Accordingly, by operating the slider in this state, the second connector housing can be moved to the normal fitting position by the action of the cam mechanism so that normal connector fitting can be achieved.

According to a third aspect of the present invention, in the low insertion pressure connector of the second aspect of the present invention, the first connector housing is a female connector housing having a fitting hole, and the second connector housing is a male connector housing to be fitted into the fitting hole of the first connector housing; the slider has upper and lower slide plates which move along upper and lower outer wall surfaces of the male connector housing; the cam mechanism has cam grooves formed in the inner surfaces of the upper and lower slide plates, and the engagement convex portions provided so as to project from the upper and lower outer wall surfaces of the male connector housing to thereby engage with the cam grooves; the release protrusions project into the cam grooves through through-holes formed in the middle of the cam grooves when the slider is in a temporary lock state; and the engagement convex portions enter into the cam grooves and interfere with the release protrusions projecting into the cam grooves to thereby bend the flexible arms to release the temporary lock state of the slider when the male connector housing is fitted into the fitting hole of the female connector housing so as to be located in the initial fitting position.

According to the third aspect of the present invention, when the slider is temporarily locked, the release protrusions provided on the flexible arms project into the cam grooves through the through-holes. When the male connector housing in this state is fitted into the female connector housing so as to reach the initial fitting position, the engagement convex portions provided in the male connector housing enter into the cam grooves. As a result, the engagement convex portions interfere with the release protrusions projecting into the cam groves to bend the flexible arms to disconnect the engagement claws from the lock positions to thereby release the temporary lock state. Accordingly, by moving the slider in this state, the slider in which the temporary lock state has been already released can be moved to the normal lock position by a slight force, so that the male connector housing can be moved to the normal fitting position by the action of the cam mechanism caused by the movement of the slider and the two connector housings are normally fitted to each other.

According to a fourth aspect of the present invention, in the low insertion pressure connector of the third aspect of the present invention, engagement concave portions are provided in the slide plates so that the lock claws engage with the engagement concave portions when the slider is moved to the normal lock position.

According to the fourth aspect of the present invention, since the lock claws are locked in the engagement convex portions when the slider is moved to the normal lock position, the slider can be locked so as not to be moved any more. Furthermore, since the cam grooves and the engagement convex portions engage with each other in this occasion, the two connector housings can be locked in the normal fitting state.

DETAILED DESCRIPTION OF THE PREFERRED EMBODIMENT

An embodiment of the present invention will be described below with reference to FIGS. 1 to 4.

A connector of the embodiment, includes a female connector housing 31, a male connector housing 32 to be fitted into a fitting hole 34 of the female connector housing 31, and a slider 33 which is attached to the female connector housing 31 so as to be slidable in a direction perpendicular to the connector fitting direction F.

Figure 1:
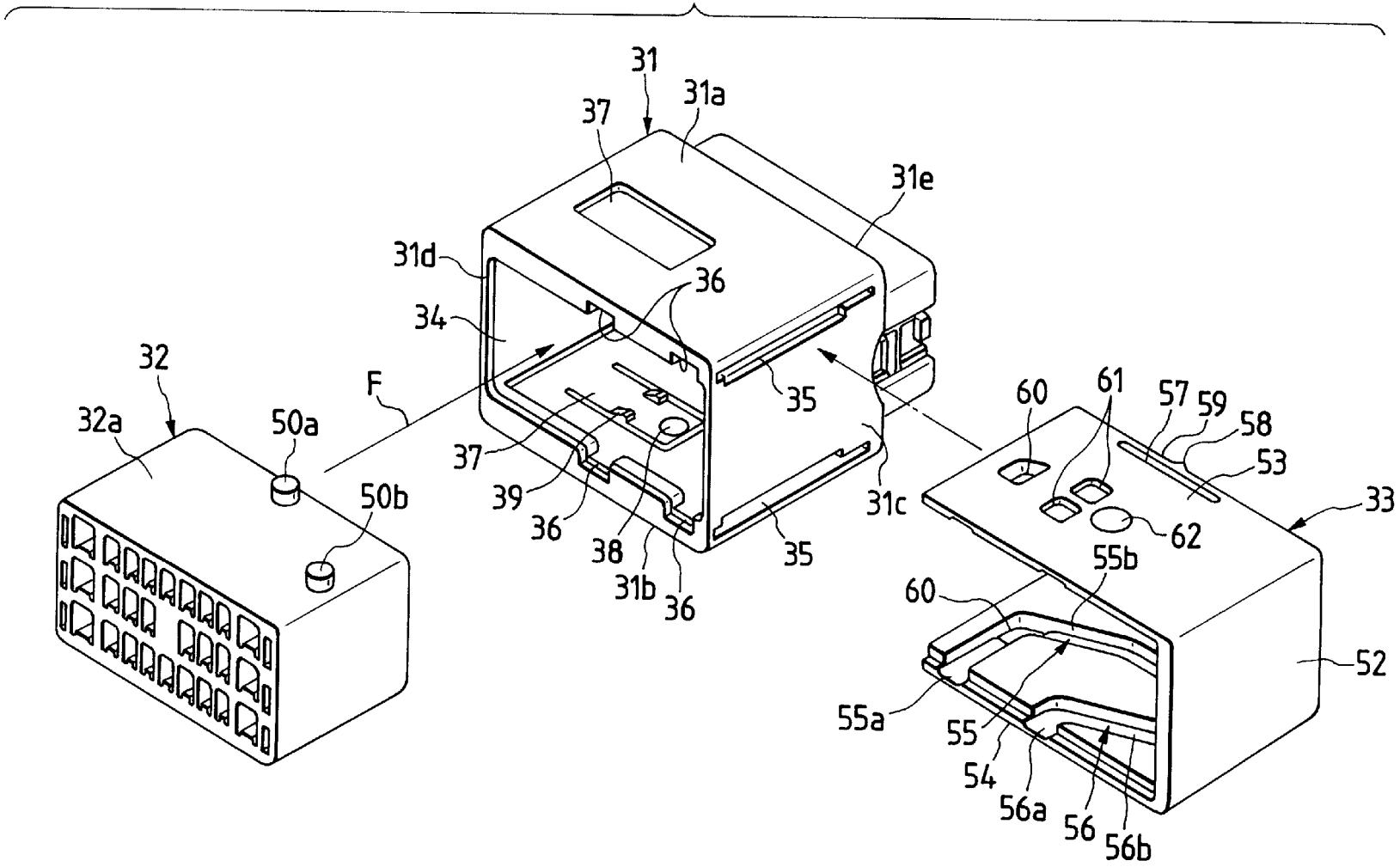
FIG. 1 is an exploded perspective view of a low insertion pressure connector according to an embodiment of the present invention.

As shown in FIG. 1, the female connector housing 31 has a male connector fitting hole 34 surrounded by an upper wall 31*a*, a lower wall 31*b*, opposite side walls 31*c* and 31*d* and a rear wall 31*e*. Insertion slits 35 are formed in two, upper and lower places of the right side wall 31*c* in FIG. 1. The slider 33 is U-shaped by upper and lower slide plates 53 and 54 which slide along upper and lower outer wall surfaces 32*a* of the male connector housing 32 when inserted into the insertion slits 35, and an operation portion 52 which connects the upper and lower slide plates 53 and 54 to each other on one side.

Flexible arms 37 are provided on an upper wall 31*a* of the male connector housing 31 and a lower wall 31*b* of the male connector housing 31, respectively, so that the flexible arms 37 can be bent in directions perpendicular to the surfaces of the upper and lower walls 31*a* and 31*b*, respectively. Lock claws (temporary lock mechanism) 39 for temporarily and normally locking the slider 33 with respect to the female connector housing 31 are provided on inner surfaces of the flexible arms 37. Further, release protrusions 38 for releasing the temporary lock of the slider 33 are formed so as to be adjacent to the lock claws 39. The release protrusions 38 are semispherical. Further, notches 36 are provided in opening edges of the front end of the female connector housing 31 so that engagement convex portions 50*a* and 50*b* which will be described later are inserted in the notches 36.

Figure 3:
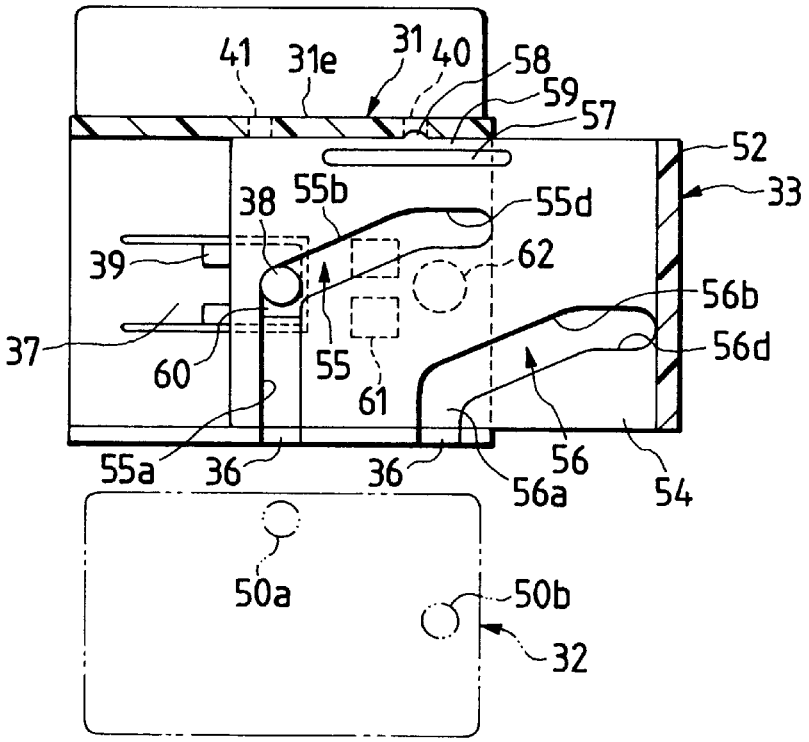
FIG. 3 is a horizontal sectional view showing a state in which the slider is temporarily locked for the female connector housing of the low insertion pressure connector in this embodiment of the present invention.

Further, two engagement convex portions 50*a* and 50*b* are provided on each of the upper outer wall surface 32*a* of the male connector housing 32 and the lower outer wall surface 32*a* of the male connector housing 32. Two cam grooves 55 and 56 are formed in each of inner surfaces of the upper and lower slide plates 53 and 54 of the slider 33 so that the two cam grooves 55 and 56 engage with the two engagement convex portions 50*a* and 50*b* respectively. The cam grooves 55 and 56 which cooperate with the engagement convex portions 50*a* and 50*b* as a cam mechanism, have inlets 55*a* and 56*a* parallel with the connector fitting direction F, inclination portions 55*b* and 56*b* provided in the rear side so as to be inclined with respect to the connector fitting direction F, and parallel portions 55*d* and 56*d* provided in the further rear side as shown in FIG. 3. The parallel portions 55*d* and 56*d* are formed to be parallel with the sliding direction of the slider 33 (that is, formed in a direction perpendicular to the connector fitting direction F).

Of the two cam grooves 55 and 56 arranged so as to be adjacent to each other, one cam groove 55 has a through-hole 60 formed in the middle of the cam groove 55 so that the release protrusions 38 project into the cam groove 55 through the through-hole 60 when the slider 33 is in a temporary lock position in which the slider is inserted shallowly. Further, in this state, front ends of the upper and lower slide plates 53 and 54 of the slider 33 strike against the lock claws 39 so that the slider 33 is securely locked in the position (temporary lock position).

Further, engagement concave portions 61 which engage with the lock claws 39 to thereby normally lock the slider 33 when the slider 33 is operated to be in the normal lock position in which the slider 33 is inserted deeply, and receiving concave portions 62 which receive the release protrusions 38 in this occasion, are formed in the outer surfaces of the upper and lower slide plates 53 and 54 of the slider 33. Further, lock pieces 59 with opposite ends fixed are formed in the rear end side edges of the upper and lower slide plates 53 and 54 such that the lock pieces 59 are made flexible at their intermediate portions by cutting parallel grooves 57 in the back along the side edges to thereby make it possible to bend intermediate portions of the lock pieces 59. Substantially triangular lock protrusions 58 are provided in the intermediate portions of the lock pieces 59, respectively. The lock protrusions 58 are designed so that the lock protrusions 58 engage with lock holes 40 provided in the rear wall 31*e* of the female connector housing 31 as shown in FIG. 3 when the slider 33 is in the temporary lock position whereas the lock protrusion 58 engage with lock holes 41 when the slider 33 is in the normal lock position.

The operation of the connector will be described below.

Figure 2:
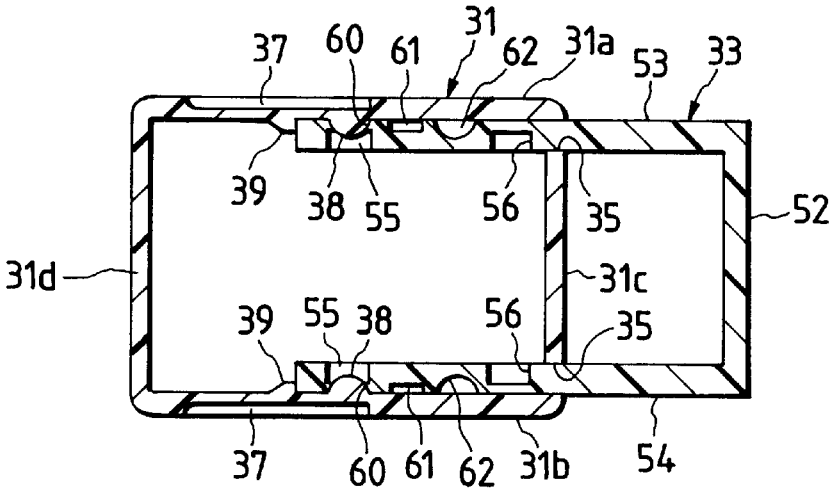
FIG. 2 is a vertical sectional view showing a state in which the slider is temporarily locked for the female connector housing of the low insertion pressure connector in this embodiment of the present invention.
Figure 4:
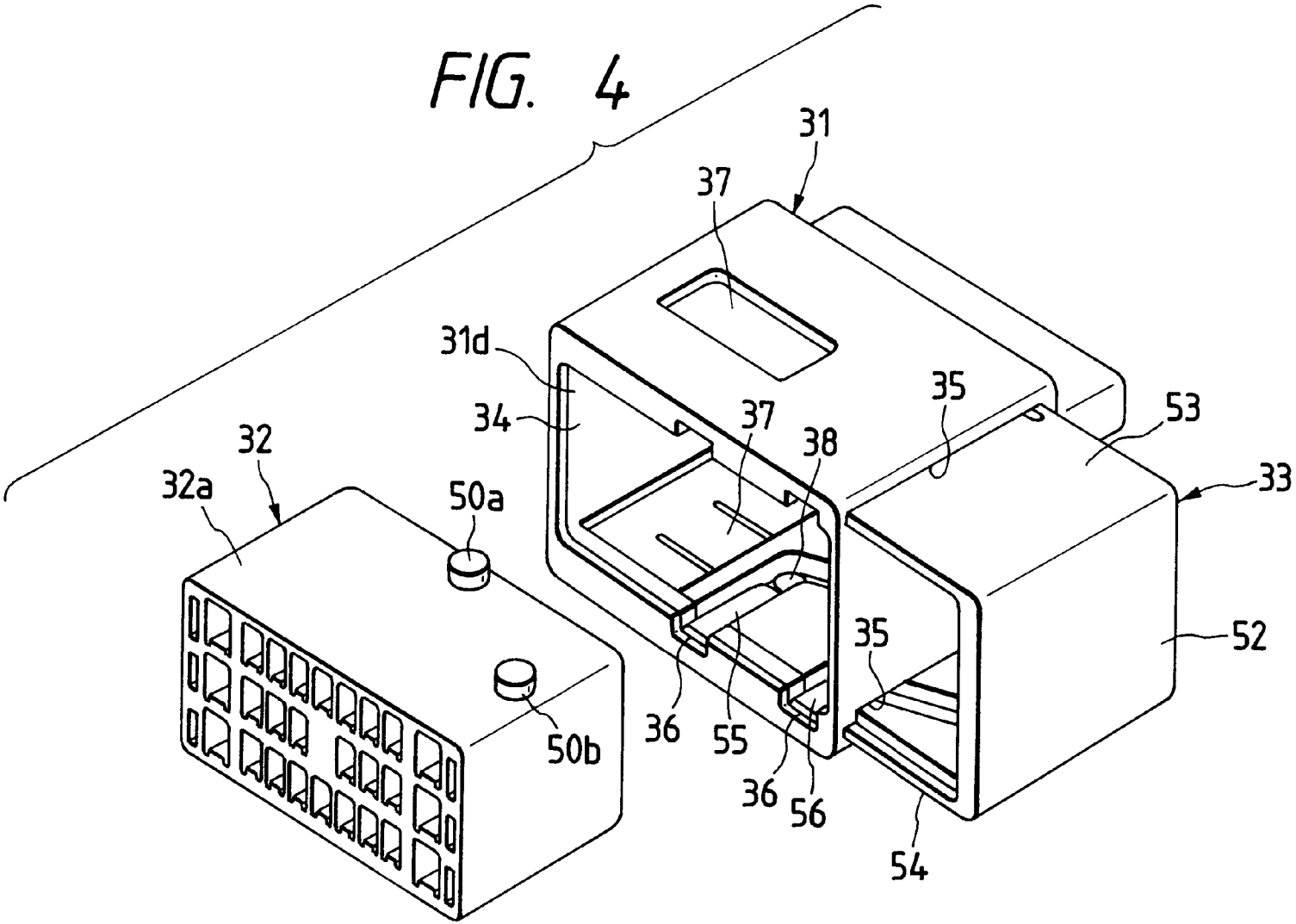
FIG. 4 is a perspective view showing a state in which the slider is temporarily locked for the female connector housing of the low insertion pressure connector in this embodiment of the present invention.
Figure 5:
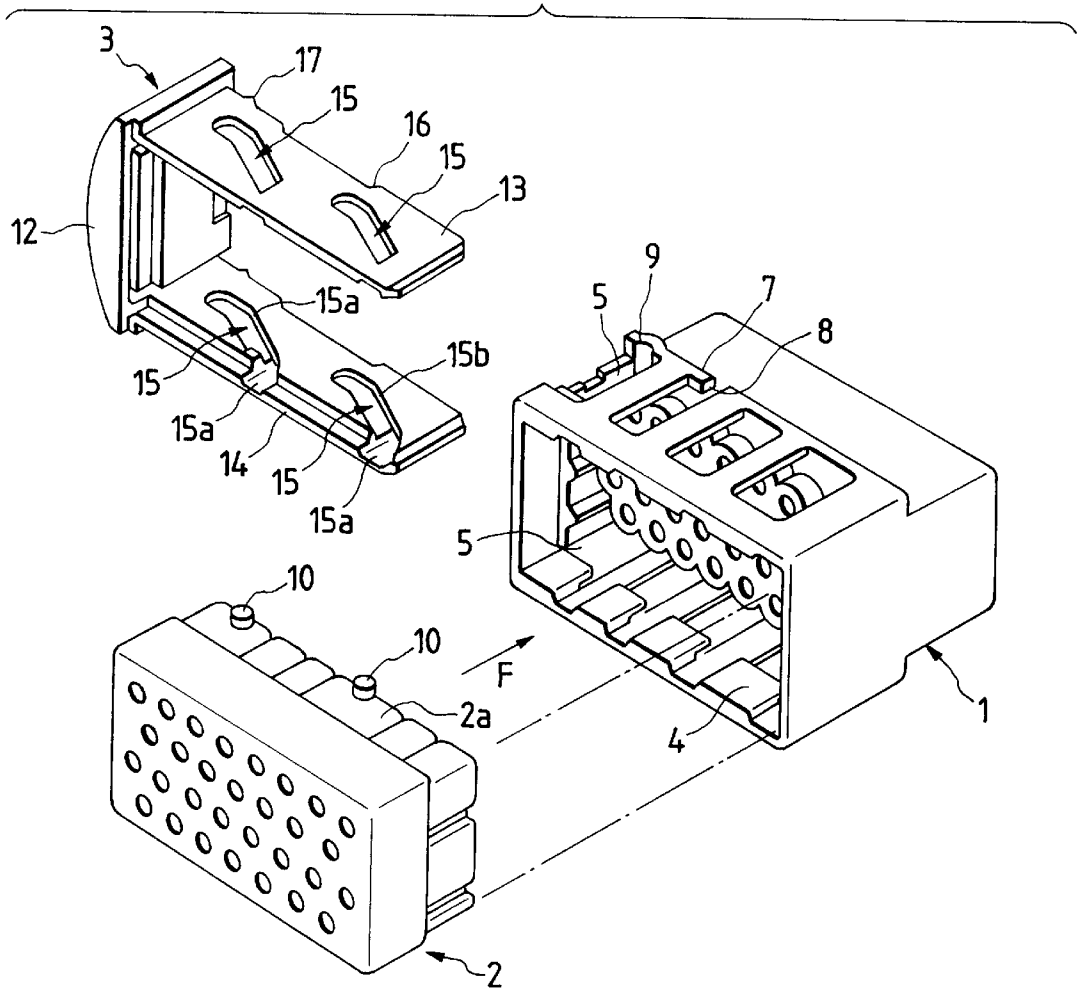
FIG. 5 PRIOR ART
FIG. 5 is an exploded perspective view showing an example of the conventional low insertion pressure connector.
Figure 6A:
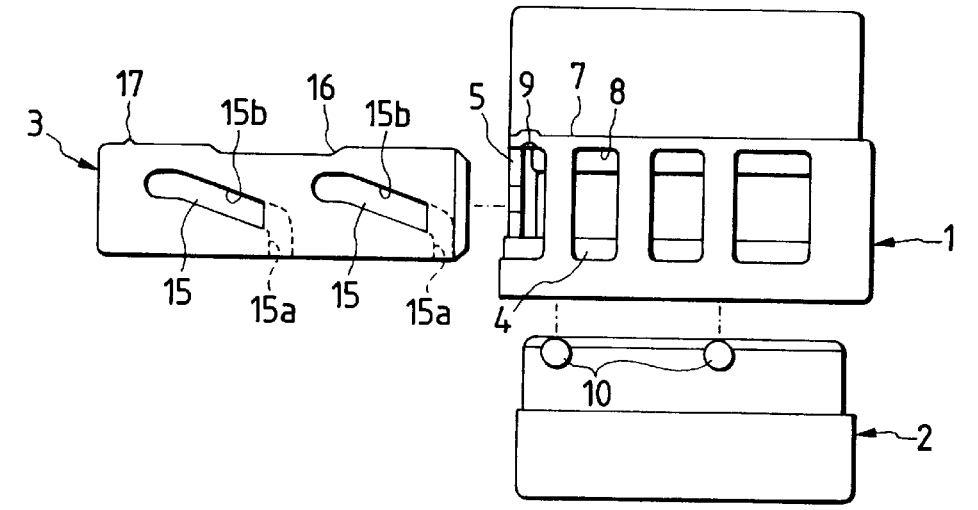
FIG. 6a PRIOR ART
FIGS. 6*a*–6*c* are views for explaining the operation of the low insertion pressure connector depicted in FIG. 5.
Figure 6B:
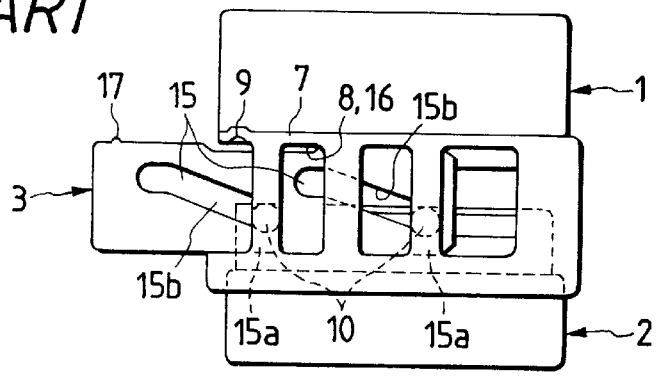
FIG. 6b PRIOR ART
Figure 6C:
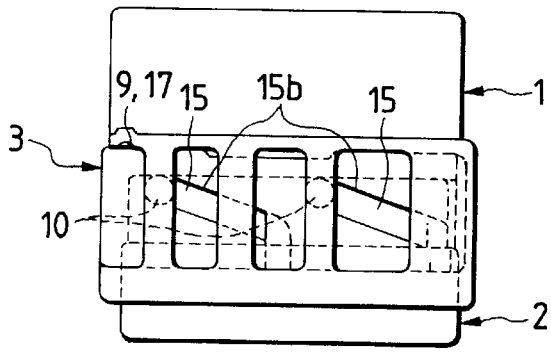
FIG. 6c PRIOR ART

Before the connector is used, the slider 33 is attached to the female connector housing 31 so as to be temporarily locked. That is, the upper and lower slide plates 53 and 54 of the slider 33 are inserted through the insertion holes 35, 35 until these plates stop. By this measure, the front ends of the slide plates 53 and 54 strike against the lock claws 39 provided in the flexible arms 37 and stop as shown in FIG. 2 to FIG. 4. In this state, the slider 33 is securely locked so as not to be inserted any more to the normal lock position which is a position deeper than the normal lock position. In this occasion, the release protrusions 38 provided on the flexible arms 37 project into the cam grooves 55 through the through-holes 60. Further, the notches 36 in the opening edges of the front end of the female connector housing 31 coincide with the inlets 55*a* and 56*a* of the cam grooves 55 and 56. At the time of carrying the connector, or the like, the connector is dealt with in this condition.

At the time of fitting of the connector, the male connector housing 32 in this state is fitted to the female connector housing 31 to be in the initial fitting position of the female connector housing 31. That is, the male connector housing 32 is inserted into the fitting hole 34 of the female connector housing 31 so that the respective engagement convex portions 50*a* and 50*b* are inserted into the respective cam grooves 55 and 56 through the inlets 55*a* and 56*a*. When the male connector housing 32 is inserted to reach an initial fitting position, the engagement convex portions 50*a* and 50*b* reach the start points of the inclination portions 55*b* and 56*b* of the cam grooves 55 and 56. As a result, the engagement convex portions 50*a* interfere with the release protrusions 38 projecting into the cam grooves 55 to press the release protrusions 38 to thereby bend the flexible arms 37. Accordingly, the lock claws 39 are separated from lock positions by the bending of the flexible arms 37, so that the temporary lock state is released (here, the release protrusions 38 and the engagement convex portions 50*a* functions as a temporary lock releasing member).

Accordingly, if the slider 33 is inserted deeper in that state, the slider 33 which has been already released from the temporary lock state can be moved to the normal lock position by a slight force, so that the male connector housing 32 can be moved to the normal fitting position and both the male connector housings 31 and 32 are normally fitted to each other by the action of the inclination portions 55*b* and 56*b* of the cam grooves 55 and 56 due to the movement of the slider 33. In this occasion, the slider 33 can be locked so as not to be moved because the lock claws 39 in the female connector housing 31 side are locked in the engagement concave portions 61 of the slider 33, so that the two connector housings 31 and 32 can be locked securely in the normal fitting state because the parallel portions 55*d* and 56*d* of the cam grooves 55 and 56 engage with the engagement convex portions 50*a* and 50*b* in this state.

Incidentally, the lock protrusions 58 engage with the temporary lock holes 40 when the slider 33 is in the temporary lock position, whereas the lock protrusions 58 engage with the normal lock holes 41 when the slider 33 is in the normal lock position. Accordingly, the slider 33 is locked more securely.

Since this connector is designed such that the temporary lock state is released before the slider 33 is moved from the temporary lock position to the normal lock position, no force is required for releasing the temporary lock state when the slider 33 is moved for the purpose of connector fitting. Accordingly, the fitting of the connectors can be performed with a slight force. Furthermore, since the temporary lock state of the slider is not released by the operation (for example, intensively pushing) of the slider 33 at the time of connector fitting, there is no problem at all even in the case where the strength of the temporary lock mechanism is selected so that the temporary lock force becomes large. Accordingly, such a situation that the slider is moved from the temporary lock position to the normal lock position by mistake due to a shock, or the like, at the time of carrying the connector can be prevented. Accordingly, improvement of workability is attained.

As described above, according to the first aspect of the present invention, since the temporary lock state of the slider is released at the point of time when the second connector housing is moved to the initial fitting position, the slider can be operated by a slight force at the time of connector fitting so that improvement in the function of the low insertion pressure connector can be attained. Furthermore, since the releasing of the temporary lock state is not made by the force of directly operating the slider, the force for retaining the temporary lock state of the slider can be selected to be intensive. Accordingly, such a situation that the slider is moved to the normal lock state due to a shock, or the like, at the time of carrying the connector can be prevented.

According to the second aspect of the present invention, since the flexible arms having lock claws and release protrusions are provided in the first connector housing and the engagement convex portions are provided in the second connector housing, the same effect as that according to the first aspect of the present invention can be achieved by a simple structure.

According to the third aspect of the present invention, since the engagement convex portions which serve as one element of the cam mechanism serve also as one element of the temporary lock releasing member, structural simplification is attained.

According to the fourth aspect of the present invention, the connector housings can be locked securely in the normal fitting state by fixing the slider in the normal lock position.

What is claimed is:

1. A low insertion pressure connector comprising:

a first connector housing and a second connector housing formed so as to fit each other, said first connector housing comprising at least one flexible arm, each arm having at least one first protrusion and a second protrusion;

a slider slidably fitted in said first connector housing in a direction perpendicular to a direction of fitting of said first and second connector housings, said slider comprising a plurality of cam groves;

a temporary lock mechanism provided between said slider and said first connector housing for locking said slider in a temporary lock position in said first connector housing;

wherein one end of said slider abuts said first protrusion of said flexible arm of said first connector housing and said second protrusion of said flexible arm protrudes through said slider in said temporary lock position;

wherein said second connector housing is moved from an initial fitting position to a normal fitting position by sliding said slider from the temporary lock position to the normal lock position; and a temporary lock releasing mechanism provided between said slider and said second connector housing, said temporary lock releasing mechanism comprising a plurality of engagement convex portions in said second connector housing, each of said engagement convex portions sliding along each of said respective cam grooves and releasing said second protrusion of said flexible aim from protruding into said slider, and flexing said flexible arm such that said first protrusion no longer abuts said one end of said slider, such that said slider can move from said temporary lock position to said normal lock position and can move said second connector housing from said initial fitting position to said normal fitting position.

2. The low insertion pressure connector of claim 1, wherein said flexible arm further comprises:

a lock claw for abutting one end of said slider and temporarily locking said slider, and a release protrusion for releasing the temporary lock state of said slider, and wherein each of said engagement convex portions of said second connector housing interfere with each of said release protrusions of said first connector housing to flex each said flexible arm to release the temporary lock state of said slider when said second connector housing is fitted in the initial fitting position.

3. The low insertion pressure connector of claim 2, wherein said slider has upper and lower slide plates which move along upper and lower outer wall surfaces of said second connector housing;

wherein said cam grooves are formed in the inner surfaces of said upper and lower slide plates, and said engagement convex portions are formed to project from the upper and lower outer wall surfaces of said second connector housing to engage with said cam grooves;

wherein said release protrusions project into said cam grooves through through-holes formed in a middle of said cam grooves when said slider is in the temporary lock state; and wherein said engagement convex portions enter into said cam grooves and interfere with said release protrusions projecting into said cam grooves to flex said flexible arms to release the temporary lock state of said slider when said second connector housing is fitted into said first connector housing so as to be located in the initial fitting position.

4. The low insertion pressure connector of claim 3, further comprising engagement concave portions provided in said slide plates so that each said lock claw engages with said respective engagement concave portions when said slider is moved to the normal lock position.

5. The low insertion pressure connector of claim 1, wherein said first connector housing is a female connector housing having a fitting hole, and said second connector housing is a male connector housing, and wherein said male connector housing is fitted into said fitting hole of said female connector housing.

* * * * *